United States Patent [19]

Stotz

[11] 4,384,922

[45] May 24, 1983

[54] INSTALLATION FOR CHARGING A MULTI-PLY HEADBOX FOR PAPERMAKING MACHINES

[75] Inventor: Wolf-Gunter Stotz, Ravensburg, Fed. Rep. of Germany

[73] Assignee: Escher Wyss GmbH, Ravensburg, Fed. Rep. of Germany

[21] Appl. No.: 325,322

[22] Filed: Nov. 27, 1981

[30] Foreign Application Priority Data

Dec. 19, 1980 [CH] Switzerland ..... 9390/80

[51] Int. Cl.[3] ..... D21F 1/06

[52] U.S. Cl. ..... 162/259; 162/262; 162/264; 162/336; 162/343

[58] Field of Search ..... 162/259, 258, 262, 264, 162/343, 336; 139/115; 417/429

[56] References Cited

U.S. PATENT DOCUMENTS

| | | | |
|---|---|---|---|
| 3,304,869 | 2/1967 | Blume | 417/429 |
| 3,951,570 | 4/1976 | De Biaggi | 417/429 |
| 4,021,295 | 5/1977 | Schmaeng | 162/259 |
| 4,086,130 | 4/1978 | Jostos | 162/259 |
| 4,153,393 | 5/1979 | Cook | 417/429 |
| 4,192,710 | 3/1980 | Bubik et al. | 162/259 |

*Primary Examiner*—William F. Smith

*Attorney, Agent, or Firm*—Werner W. Kleeman

[57] ABSTRACT

An installation for charging a multi-ply headbox, wherein the mixing pumps of the stock infeed systems for the stock which is diluted with water, i.e. the stock slurries, are driven by a single drive motor by means of a common shaft. Additionally, a pressure differential-regulation device is provided for the fine tuning or coordination of the pressures of the stock suspensions in the headbox. Signals are inputted by means of pressure feelers or sensors to the pressure differential-regulation device. As a function of the deviations from a set or reference value there are activated regulation valves which are arranged in bypass lines shunting the mixing pumps. The bypass lines or conduits flow communicate with sieve water containers connected with the suction side of the mixing pumps. Through these measures there is avoided mechanical damage to the headbox, particularly to the partition walls arranged internally thereof.

11 Claims, 1 Drawing Figure

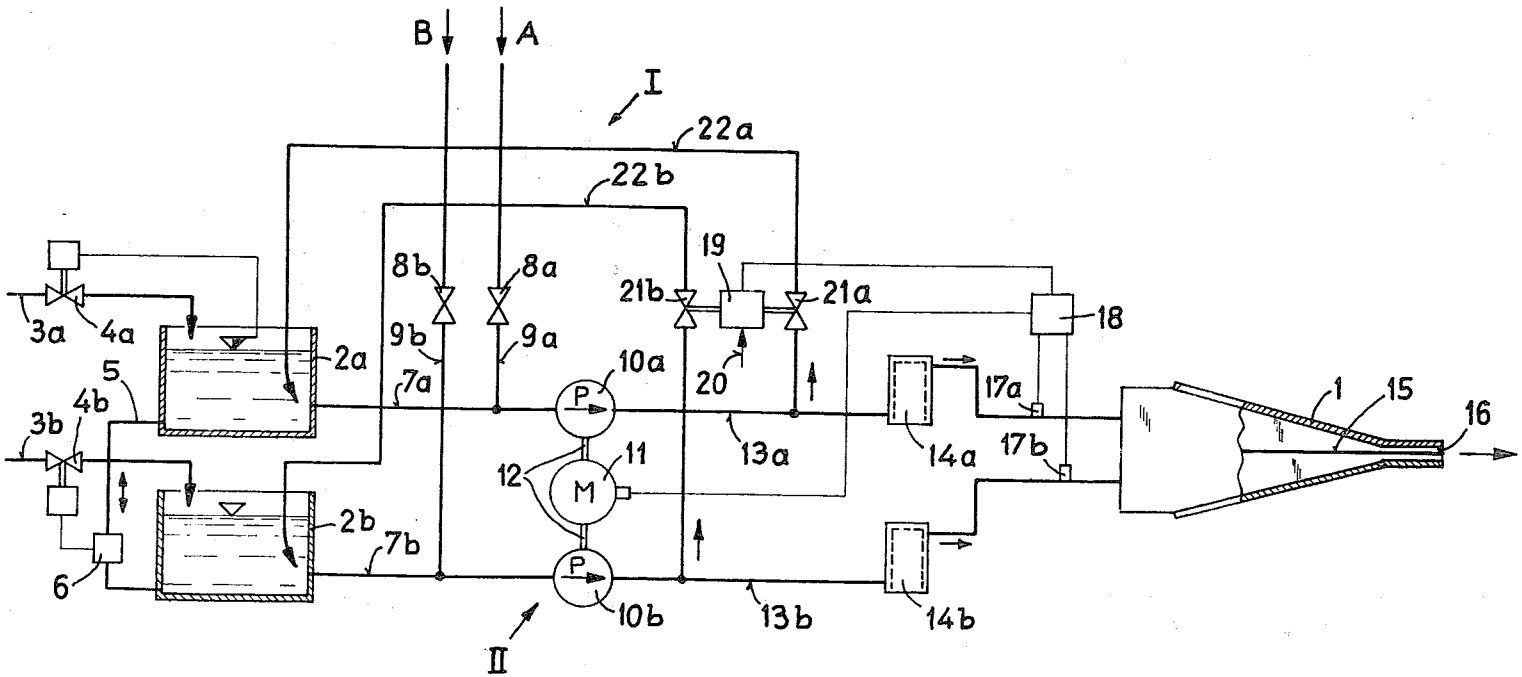
16
15
1
18
17a
17b
14a
14b
21a
13a
13b
22a
19
20
I
22b
21b
10a
11
10b
A
8a
9a
12
II
B
8b
9b
7a
7b
2a
2b
4a
5
4b
6
3a
3b

INSTALLATION FOR CHARGING A MULTI-PLY HEADBOX FOR PAPERMAKING MACHINES

BACKGROUND OF THE INVENTION

The present invention relates to a new and improved construction of installation for charging or loading a multi-ply headbox for a papermaking machine, wherein at least two stocks diluted with water are infed in each case with the aid of an associated mixing pump to the headbox.

As is well known in the papermaking industry headboxes are used for producing a fiber web or fiber webs during the fabrication of multi-ply paper composed of at least two layers or plies have different material properties and/or different layer or ply thickness.

There are known in this technology a multiplicity of different constructions of multi-ply headboxes. By way of example reference is made to Swiss Pat. No. 619,777 and the corresponding U.S. Pat. No. 4,192,710 which describes a multi-ply headbox.

It is to be understood that the teachings of the present development are not limited to a special design of such type of multi-ply headbox. Within the headbox nozzle or flow channel there are arranged partition or separation walls which form within the channel of the headbox sub-channels or sub-passages for the different stock suspensions. The partition walls can be rigid walls or also flexible walls, for instance formed of plastic or thin sheet metal. Also, it is possible to design the partition walls so that a part thereof is rigid and another part is flexible, for instance at the end of the headbox channel.

Heretofore it was conventional practice to separately drive the mixing pumps of the infeed systems for the infeed of the individual stock suspensions to the headbox.

As is well known to those skilled in this art appreciable internal pressures, for instance in the order of up to approximately 2 to 10 bar, prevail within the headboxes. Now if during operation of a stock infeed system a mixing pump fails, for instance one of the mixing pumps is damaged, then the partition walls and, under circumstances, also the infeed channel walls within the headbox are exposed to high pressure differentials. These high pressure differentials can cause such walls to deform and possibly to become severely damaged, so that the headbox no longer is capable of properly operating. As a result, the entire production output of the papermaking machine is brought to standstill.

SUMMARY OF THE INVENTION

Therefore, with the foregoing in mind it is primary object of the present invention to overcome the aforementioned drawbacks and shortcomings of the prior art discussed above.

Another and more specific object of the present invention aims at providing a suitable construction of the charging or loading installation of a multi-ply headbox in order to ensure for a disturbance-free operation of the headbox, and, in particular, to avoid the occurrence of pressure differences which could result in destruction of the headbox.

Still a further significant object of the present invention aims at the provision of a new and improved installation for charging a multi-ply headbox for papermaking machines which is relatively simple in construction and design, extremely reliable in operation, not readily subject to breakdown or malfunction, and requires a minimum of maintenance and servicing.

A still further significant object of the present invention aims at providing a new and improved construction of installation for charging a multi-ply headbox with stock suspensions during the production of paper in a papermaking machine, which stock suspension-charging installation incorporates means safeguarding against possible destruction or damage to the headbox by virtue of pressure differentials which are predicated upon malfunction of a stock mixing pump.

Now in order to implement these and still further objects of the invention, which will become more readily apparent as the description proceeds, the installation for charging a multi-ply headbox of a papermaking machine as contemplated by the invention is manifested by the features that the mixing pumps are equipped with a synchronous drive or drive means.

The invention also contemplates an arrangement wherein the mixing pumps responsible for the infeed of the stock suspensions to the headbox are driven by separate drive motors which are operatively coupled by means of an electrical shaft. Upon dropout or malfunction of a drive motor there is interrupted the electrical shaft, so that all mixing pumps are simultaneously shutdown.

According to a preferred embodiment of the invention all of the mixing pumps are driven by a single drive motor by means of a common shaft. To the extent that the shaft has a multi-part design then the individual shaft parts are interconnected with one another by means of a related coupling or equivalent structure.

Instead of using a mechanical coupling of the mixing pumps with one another by means of a shaft it is possible to connect the mixing pumps with the drive motor also by means of at least one mechanical drive or power transmitting arrangement, such as for instance toothed belts, sprocket chains, gears or the like.

By means of this synchronous drive there is obtained the beneficial result that at all times all of the stock suspensions in the headbox experience the same pressure and quantitative conditions.

A further advantage of the invention resides in the fact that by virtue of synchronously rotating the impellers of the mixing pumps, which may be structured as centrifugal pumps, the rhythmic or cyclic pressure surges which are caused by the impeller blades, can be maintained in a predetermined in-phase or out-of-phase relationship and there can be beneficially avoided pressure fluctuations within the headbox, which, in particular, impair the quality of the fabricated paper and can induce unwanted oscillations of the headbox.

The term "in-phase" as used in the context of this disclosure is intended to mean a setting or adjustment of the mixing pumps wherein, in each case, a respective impeller blade is located opposite a guide blade in each pump housing, whereas the term "out-of-phase", as used in this disclosure, is intended to indicate an operating condition wherein the impeller blades and the guide blades from pump to pump are coupled in offset relationship with respect to one another through a predetermined angle.

In the first-mentioned operating case the pressure surges of the different stock streams within the headbox appear simultaneously. Hence, there is avoided any "fluttering" of the partition walls.

In the "out-of-phase" operating mode the arriving pressure surges are mutually shifted in time with respect to one another and thus cause a certain damping of the pressure pulsation of the stock suspension in the free jet.

Which particular synchronization mode is employed is dependent upon the individual operating condition.

An advantageous further design of the present invention resides in the features that for a fine coordination or tuning of the pressures of the stock streams there is provided a pressure differential-regulation device. Pressure signals are inputted to this pressure differential regulation device and these pressure signals are determined shortly before or within the infeed device or in the infeed channel of the headbox. Additionally, the water for the infeed systems advantageously is removed in each instance from a level-controlled water container or receptacle, for instance a sieve or filter water container. Each mixing pump is shunted or bridged by a bypass line connected with the related water container. In each bypass line there is arranged a regulation element which can be influenced by the regulation device.

With the aid of the pressure differential regulation device there is possible a more rapid pressure compensation in the presence of small pressure differentials arising in the stock infeed systems. It is advantageous when pressure deviations occur to simultaneously actuate all of the regulation elements, which during normal operation assume an intermediate position, in a manner such that, for instance, in the case of a dual-stock system the one regulation element further opens from a minimum open position, whereas the other regulation element continues to progressively close from a likewise minimum open position. Hence, by virtue of such overlapping movements there never arises any uncontrolled situation and the regulation operations occur extremely rapidly and precisely.

However, it is also possible to individually actuate independently of one another the regulation elements by means of the pressure differential-regulation device.

Upon exceeding a maximum pressure differential, irrespective of the reason that such arises notwithstanding the regulation operation which has occurred, a further advantageous construction of the invention contemplates turning-off the drive motor by means of a signal delivered by a measuring device and thus shutting down the entire installation. A maximum impermissible pressure differential can arise, for instance, at leakage locations or in the event there occurs a rupture in the line or conduit system.

The slightest and even the largest pressure differentials in the infeed systems, and thus, in the headbox can arise, for instance, because of clogging of equipment or fixtures of the installation by contaminants within the stock suspension or by the fibers. Such equipment which can become clogged may be, for instance, the so-called pressure sorters or sifters, such as for instance, described in Swiss Pat. No. 564,638, and flow measuring devices or meters, valves and the like.

Another advantageous embodiment of the invention contemplates that the level-controlled water containers arranged at the suction sides of the mixing pumps are connected in flow communication with one another by means of a bypass line and when working with more than two stock suspensions by means of bypass lines or conduits.

Consequently, there is realized the advantage that in the event a level regulator becomes defective or if for any other reason the water feed to a container is interrupted this container cannot empty, rather by means of the bypass arrangement will again be filled with water to the same level from the other container. Hence, there is precluded that, in the event of malfunction of one of the stock infeed systems, the pump will run dry and destroy the headbox.

With this safety measure there is, however, tolerated the fact that the composition of the water or like contents of the container filled by the bypass line arrangement is somewhat different than its composition during normal operation. Yet, by the provision of such safety measure there is importantly, however, prevented the destruction of the subsequently arranged equipment.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically illustrates an exemplary embodiment of installation for charging or loading a multi-ply headbox for a papermaking machine according to the invention.

DETAILED DESCRIPTION OF THE PREFERRED EMBODIMENTS

Describing now the drawing, it is to be understood that only enough of the construction of the papermaking machine has been disclosed herein, in order to simplify the illustration, and needed for those skilled in this art to readily understand the underlying principles and concepts of the present development. The illustrated exemplary embodiment is directed to the fabrication of a paper web composed of two plies or layers. However, it is to be understood that the principles and concepts of the invention also embrace situations different than those described by way of example and not limitation, for instance are applicable to the fabrication of paper composed of more than two plies.

In the embodiment under discussion it will be seen that the installation contains two stock suspension-infeed systems I and II for the charging of a headbox 1. In each case a level-controlled water container **2*a* and 2*b* is arranged at the related stock infeed system I and II, respectively. These water containers 2*a* and 2*b* are fed by means of the lines or conduits 3*a* and 3*b*, in which there are arranged regulation valves 4*a* and 4*b*, respectively, for instance with sieved or filtered water from the entire installation. Moreover, both of the containers or receptacles 2*a* and 2*b* are connected with one another by means of a bypass line or conduit 5**, the function of which has already been described heretofore in detail.

Although the water containers **2*a* and 2*b* can be level-regulated or level-controlled in each instance independently of one another, it is also possible, as has been illustrated in the exemplary embodiment, to regulate in the manner of a follow-up regulation the second water container as a function of the level regulation of the first water container. For this purpose there is arranged in the bypass line or conduit 5 a through-flow meter or measuring device 6 which, as a function of the degree of filling of the water container 2*a*, initiates by means of a signal a corresponding opening of the regulation valve 4*b* in a manner such that there can be adjusted at both water containers or receptacles 2*a* and 2*b*** the same constant level.

When working with more than two sieve water containers or the like, for instance in a three stock system, the level control or regulation can be accomplished in series, i.e. successively as a function of the level of a first sieve water container or, however, independently of one another. In the first instance all of the sieve water containers are connected by means of a common bypass line or conduit with the first sieve water container, whereas in the second case each further sieve water container is connected with the first sieve water container by means of a separate bypass line in which there is arranged a through-flow meter or measuring device.

Valves 8a and 8b provided with infeed lines 9a and 9b open into the pipe lines or conduits 7a and 7b, respectively. By means of the infeed lines or conduits 9a and 9b there can be infed to the installation stock suspensions A and B of different material properties.

The lines or conduits 7a and 7b are connected with the suction side of related mixing pumps 10a and 10b, respectively, which may be for instance centrifugal pumps. These centrifugal mixing pumps 10a and 10b, serving for conveying or feeding the stock suspensions to the headbox 1, are driven by a single drive motor 11 by means of a common shaft 12. The pumps 10a and 10b are designated as "mixing pumps" since there is accomplished therein automatically an additional mixing of the stock or stock suspension A and B with the sieve or filtered water.

In the exemplary embodiment there are arranged, for instance so-called pressure sorting devices 14a and 14b of conventional construction in the feed lines 13a and 13b leading from the outlet side of the related pumps 10a and 10b, respectively.

The headbox 1, which only has been schematically illustrated and the construction of which shall be considered below to the extent needed for appreciating the teachings of the invention, will be seen to contain a partition wall 15, which, for instance, can be formed of a rigid sheet metal element, and therefore forms within the headbox 1 two partial channels or sub-passages for the stock suspensions. The stock jets or streams are deposited through an outlet gap or slice opening 16 for instance in a not here further illustrated manner, but as is well known in the papermaking art, between two wires or sieves which are guided over two cylinders and at that location form a double-ply fiber web.

In the illustrated exemplary embodiment the feed or conveying lines 13a and 13b are provided with a related pressure sensor or feeler 17a and 17b, respectively, at a location shortly before their connection with the headbox 1. Of course, these pressure sensors or feelers 17a and 17b also can be arranged within the headbox 1 at appropriate locations thereof, for instance in channels of the infeed device or in the partial channels or sub-passages at the terminal region of the headbox flow channel.

The signals of the pressure feelers 17a and 17b are inputted in each instance to a measuring device 18 which forms a differential or difference signal. This difference signal is infed to a suitable pressure differential-regulation device 19 which compares the difference signal with a set or reference value signal, generally indicated by reference character 20.

As soon as the signal indicates a pressure differential deviating from the set or reference value 20, then the regulation device 19 forms regulation signals which are delivered to the regulation valves 21a and 21b, respectively, or equivalent regulating elements.

These regulating valves 21a and 21b are arranged in bypass lines or conduits 22a and 22b, respectively, which bypass or shunt the mixing pumps 10a and 10b respectively, and open into the water containers 2a and 2b, respectively.

In the presence of slight pressure differentials, caused for instance by changed flow losses at the equipment 14a or 14b the regulation valves 21a and 21b are simultaneously actuated in a manner such that with the illustrated dual stock system, and as has already been previously described in detail, the one regulation valve further opens from a minimum open position, whereas the other regulation valve progressively closes from a likewise minimum open position.

Under circumstances one of the regulation valves also can remain closed and only the regulation valve of one bypass line can be correspondingly opened.

If the measuring device 18 indicates a predetermined maximum pressure differential, which no longer can be compensated by the bypass lines or conduits, then there is delivered by the measuring device 18 a signal to the drive motor 11. This signal causes shutdown of the drive motor 11, so that the entire charging installation is brought to standstill and there is effectively avoided any damage to the headbox 1.

While there are shown and described present preferred embodiments of the invention, it is to be distinctly understood that the invention is not limited thereto, but may be otherwise variously embodied and practiced within the scope of the following claims. Accordingly,

What I claim is:

1. An installation for charging a multi-ply headbox of a papermaking machine, comprising:

a multi-ply headbox containing headbox partial channels;

means for supplying to the headbox at least two different stocks which have been diluted with water and forming at least two stock suspensions flowing through respective ones of said partial channels;

said stock supplying means comprising a respective mixing pump for each stock suspension;

synchronous drive means provided for said mixing pumps;

said stock suspension supplying means comprising a respective sieve water container for each stock which is to be diluted;

conduit means for connecting each sieve water container with its related mixing pump at a suction side thereof; and bypass line means for interconnecting in flow communication with one another the sieve water containers to prevent dry running of said mixing pumps.

2. The installation as defined in claim 1, wherein:

said synchronous drive means comprises a single drive motor driving by means of a common shaft said mixing pumps.

3. The installation as defined in claim 2, wherein:

said common shaft comprises a multi-part shaft; and the individual shaft parts being interconnected by means of a coupling with one another.

4. The installation as defined in claim 1, wherein:

said synchronous drive means comprises a single drive motor for driving said mixing pumps by means of at least one mechanical drive arrangement.

5. The installation as defined in claim 1, wherein:

a pressure differential-regulation device for controlling the pressures of the stock suspension in the partial channels of the multi-ply headbox;

means for generating pressure signals responsive to the pressure conditions in the stock suspensions; and said pressure signals being inputted to said pressure differential-regulation device.

6. The installation as defined in claim 5, wherein:

said means for generating pressure signals comprises pressure signal-generating means arranged in lines leading to the partial channels of said headbox.

7. The installation as defined in claim 1, further including:

means including said bypass line means for regulating the contents of the sieve water containers to an equal and essentially constant level.

8. The installation as defined in claim 7, wherein:

a pressure differential-regulation device for controlling the pressures of the stock suspension in the partial channels of the multi-ply headbox;

means for generating pressure signals responsive to the pressure conditions in the stock suspension;

said pressure signals being inputted to said pressure differential-regulation device;

a bypass line for bridging each mixing pump;

each said bypass line being connected with its related sieve water container;

each bypass line containing a regulating element; and said regulation device controlling each said regulating element.

9. The installation as defined in claim 8, wherein:

said pressure-differential regulation device simultaneously controlling all regulating elements in the bypass line in response to pressure deviations of the streams of stock suspensions.

10. The installation as defined in claim 8, wherein:

said synchronous drive means comprises a single drive motor for driving said mixing pump;

a signal line for connecting said regulation device with said drive motor; and said signal line serving to shutdown said drive motor upon attaining a maximum pressure differential of the streams of stock suspensions.

11. The installation as defined in claim 7, wherein:

only one of the sieve water containers is directly level regulated;

said regulating means including a regulation valve arranged in an infeed line of the other sieve water container; and said regulation valve causing the same level setting of the other sieve water container as a function of a through-flow meter arranged in the bypass line means.

* * * * *